US007183510B2

(12) United States Patent
Ami et al.

(10) Patent No.: US 7,183,510 B2
(45) Date of Patent: Feb. 27, 2007

(54) SWITCHING DEVICE

(75) Inventors: Hiroyuki Ami, Utsunomiya (JP); Kiyotaka Yamaguchi, Nogoya (JP); Hideyo Kakuno, Tajimi (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 11/386,049

(22) Filed: Mar. 21, 2006

(65) Prior Publication Data

US 2006/0260920 A1 Nov. 23, 2006

(30) Foreign Application Priority Data

May 23, 2005 (JP) ..... 2005-150086

(51) Int. Cl.
*H01H 19/06* (2006.01)

(52) U.S. Cl. ..... 200/302.3; 200/339

(58) Field of Classification Search ..... 200/4, 200/5 R, 1 B, 339, 302.1–302.3
See application file for complete search history.

(56) References Cited

U.S. PATENT DOCUMENTS 4,968,862 A * 11/1990 Maeda ..... 200/5 R
5,117,074 A 5/1992 Yanai et al.
5,283,407 A * 2/1994 Pohl ..... 200/332
5,647,478 A 7/1997 Hirai
5,824,981 A 10/1998 Suzuki et al.
6,011,226 A * 1/2000 Sadowski et al. ..... 200/302.3
6,380,500 B1 * 4/2002 Lin ..... 200/302.3
6,444,930 B1 * 9/2002 MacDonald et al. ..... 200/302.3
6,465,753 B1 * 10/2002 Wang ..... 200/302.1
6,610,945 B2 * 8/2003 Onodera ..... 200/315
6,750,406 B2 * 6/2004 Komatsu et al. ..... 200/1 B
6,911,612 B2 * 6/2005 Seki ..... 200/339

OTHER PUBLICATIONS

Patent Abstracts of Japan, Publication No.: 05-314864, Publication Date: Nov. 26, 1993, 1 page.
Patent Abstracts of Japan, Publication No.: 11-086662, Publication Date: Mar. 30, 1999, 1 page.
European Search Report dated Sep. 8, 2006; Application No. 06004655.4 (7 pages).

* cited by examiner

*Primary Examiner*—Michael Friedhofer
(74) *Attorney, Agent, or Firm*—Osha Liang L.L.P.

(57) ABSTRACT

A switching device capable of preventing entrance of water from outside of a case through a space below an operation knob into the case is disclosed. The switching device includes: a switch; a case within which the switch is accommodated; a hollow cylinder which is provided on the upper surface of the case 1 and open to above and below to communicate with the inside of the case 1; an operation knob provided to cover the upper opening of the cylinder such that the operation knob can swing; and an operation bar which extends through the lower opening of the cylinder into the case to transmit the motion of the operation knob to the switch. A projection is provided on the upper surface of the case in the vicinity of the cylinder. The lower end of the operation knob is opposed to the upper end of the projection with a small clearance interposed therebetween when the operation knob is not shifted.

6 Claims, 12 Drawing Sheets

SWITCHING DEVICE

BACKGROUND OF THE INVENTION

1. Field of the Invention

The present invention relates to a switching device for switching on and off by operation of an operation knob which swings, and more particularly to a waterproof-type switching device capable of preventing water from entering into its case.

2. Description of Related Art

FIG. 11 is a side view schematically showing a structure of a switching device 100 used in a window open/close system (power window system) of a vehicle. The switching device 100 has a case 1, and switches, a circuit board and other components which will be described later are accommodated inside the case 1. A seesaw-motion type operation knob 6 of a window open/close switch is operated to open and close a window of the vehicle. The operation knob 6 has an operation section 6*a*, a cap section 6*b* formed integrally with the operation section 6*a*, and holes 6*c* formed on the side walls of the cap section 6*b*. A cylinder 7 is provided on an upper surface 1*e* of the case 1, and a shaft 7*a* is formed integrally with the outer wall of the cylinder 7. The cap section 6*b* of the operation knob 6 is attached to the cylinder 7 from above, and the holes 6*c* of the operation knob 6 are brought into engagement with the shaft 7*a* of the cylinder 7. By this engagement, the operation knob 6 is supported by the cylinder 7 such that the operation knob 6 can swing around the shaft 7*a*. An operation knob 4 is an operation knob of a door lock switch, and is operated to lock the doors of the vehicle such that the doors cannot be opened, and to release the lock. The switching device 100 is attached to an arm rest (not shown) provided on the door of the driver's seat of the vehicle, and is covered by a cover 11 shown in FIG. 3 in areas other than the positions of the operation knobs.

FIG. 12 is a cross-sectional view showing a main part of the switching device 100 to which the cover 11 is attached. As apparent from the figure, the cylinder 7 is a hollow cylinder which is open to above and below to communicate with the inside of the case 1. A circuit board 14 is provided inside the case 1, and a switch 13 is packaged on the circuit board 14. The switch 13 is a switch for opening and closing a window, and is formed by a known slide switch. The switch 13 has an actuator 13*a*. An operation bar 12 connected to the operation knob 6 extends through a lower opening 7*c* of the cylinder 7 toward the inside of the case 1. A concave 12*a* is formed at the lower end of the operation bar 12. By engagement between the concave 12*a* and the actuator 13*a* of the switch 13, the motion of the operation knob 6 is transmitted through the operation bar 12 to the switch 13, and contacts equipped inside the switch 13 are switched between on and off in accordance with the operating position of the operation knob 6. A point Q is the rotation center of the operation knob 6, and corresponds to the position of the shaft 7*a* shown in FIG. 11. An opening 1*a* through which the finger is inserted to operate the operation section 6*a* of the operation knob 6 is formed on the cover 11. The operation section 6*a* is exposed through the opening 11*a*.

A switching device having a similar structure as that of the switching device 100 explained above is shown in JP-A-8-180755 and JP-A-5-314864 (Patent References 1 and 2). JP-A-11-86662 (Patent Reference 3) discloses a switching device having a similar structure as above, which is waterproofed by surrounding soldered portions of electronic component terminals on a circuit board with side walls formed by rubber contact members without requiring coatings.

In the switching device 100 described above, the opening 11*a* of the cover 11 is sized large enough to prevent any trouble which may be caused when putting the finger on the operation section 6*a* of the operation knob 6 to lower or raise the operation section 6*a*. As a result, raindrops entering through the window which has been left open, beverage accidentally spilt in the vehicle compartment or the like (hereinafter collectively referred to as "water") flow through the opening 11*a* toward the concave 11*b* in some cases as illustrated in FIG. 12. In this case, the water entering the concave 11*b* flows through a clearance 15 formed between a bottom wall 11*f* of the concave 11*b* and the cap section 6*b* of the operation knob 6 and through a clearance 16 formed between the bottom wall 11*f* and the case 1 to be discharged to the outside. However, when a large amount of water flows into the concave 11*b*, the water is not sufficiently discharged and flows through the clearance 15 into a space between the cap section 6*b* of the operation knob 6 and a side wall 7*e* of the cylinder 7. When the level of water staying in this space reaches the level of water in the concave 11*b* and exceeds the height of the side wall 7*e* of the cylinder 7, water flows through an upper opening 7*b* into the cylinder 7. Then, the water coming into the cylinder 7 passes through the lower opening 7*c* of the cylinder 7 and enters into the case 1. Bold arrows shown in FIG. 12 indicate the flow path of the water.

For overcoming this problem, it is considered that lengths A and B shown in FIG. 12 are widened. In this case, the discharge amount increases, thereby offering advantages to a certain extent. However, there is a limitation to widening the lengths A and B since design improvement and miniaturization considering the component arrangement within the case 1 are required. Thus, in the conventional switching device, water cannot be sufficiently discharged when a large volume of water flows into the concave 11*b* at a time and thus entrance of water into the case 1 cannot be prevented.

Nothing is described about prevention of water which enters from below the operation knob 6 in Patent Reference Nos. 1 and 2. Additionally, while Patent Reference No. 3 discloses a waterproofing technique for preventing short-circuit, entrance of water from below the operation knob into the case cannot be prevented in such a switching device which does not use rubber contacts according to the technique shown in this reference.

SUMMARY OF THE INVENTION

Accordingly, it is an object of the invention to provide a switching device capable of preventing water from entering from outside of a case through a space below an operation knob into the case.

A switching device according to the invention includes: a switch; a case within which the switch is accommodated; a hollow cylinder which is provided on the upper surface of the case and open to above and below to communicate with the inside of the case; an operation knob provided to cover the upper opening of the cylinder such that the operation knob can swing; and an operation bar which extends through the lower opening of the cylinder into the case to transmit the motion of the operation knob to the switch. A projection for preventing water from entering through a space between the operation knob and the cylinder into the case is provided on the upper surface of the case in the vicinity of the cylinder. The lower end of the operation knob is opposed to the upper end of the projection with a small clearance interposed therebetween when the operation knob is not shifted, and the lower end of the operation knob moves away from the upper end of the projection when the operation knob is shifted.

In this structure, the projection prevents entrance of water which flows from below the operation knob and approaches the inside of the cylinder without obstructing the swinging motion of the operation knob. Even when an extremely small amount of water enters through the small clearance between the operation knob and the projection, the water is prevented from entering through the upper opening into the case since the amount of water is small and the level of water staying in the space between the operation knob and the cylinder does not exceed the level of the upper opening of the cylinder. The switch according to the invention is not limited to a switch having a housing, but may be other switches such as a contact used for switching on/off of electrical current supply and a switching element itself. The projection provided on the case upper surface according to the invention may be a projection provided within a concave formed on the case upper surface. Additionally, the projection may be not only a projection contacting the case upper surface but also a projection not contacting the case supper surface. For example, a structure in which a projection is provided on the side surface of the cylinder with a space produced between the projection and the case is included in the scope of the invention.

According to the invention, it is preferable that the space between the operation knob and the projection becomes the minimum equal to the small clearance when the operation knob is not shifted. In this structure, since the clearance between the operation knob and the projection becomes the minimum when the operation knob is at the neutral position, entrance of water into the case can be effectively prevented in the normal condition where the operation knob is not operated.

According to the invention, it is preferable that the projection has a tapered surface which comes opposed to the operation knob when the operation knob is shifted. In this structure, the operation knob comes opposed to the projection when the operation knob is shifted. Since the distance between these components is decreased to such an extent that the swinging motion of the operation knob is not obstructed, entrance of water into the case can be effectively prevented not only when the operation knob is not shifted but also when the operation knob is shifted. The tapered surface may have a substantially circular-arc shape corresponding to a track defined by the lower end of the operation knob. In this structure, the distance between the operation knob and the projection when the operation knob swings can be further decreased and thus the waterproofing effect can be enhanced.

According to the invention, the projection prevents entrance of water flowing from below the operation knob into the case without obstructing the motion of the operation knob. Therefore, the switching device can be effectively waterproofed.

DESCRIPTION OF PREFERRED EMBODIMENTS

Figure 1:
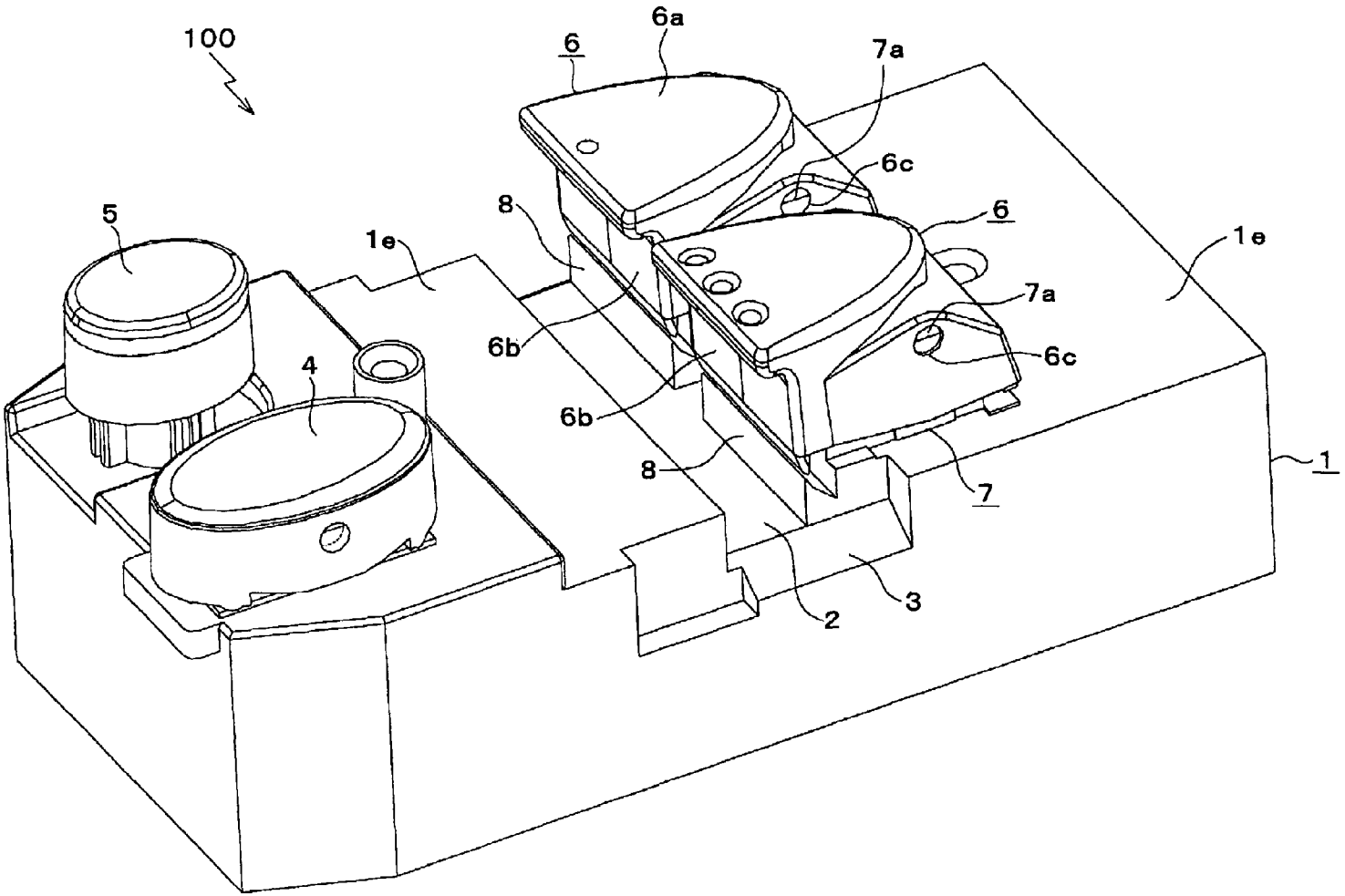
FIG. 1 illustrates an external appearance of a switching device in an embodiment according to the invention.

An embodiment according to the invention is hereinafter described with reference to FIGS. 1 through 7. In these figures, similar reference numerals are given to similar components.

FIG. 1 illustrates an external appearance of an example of a switching device 100 used in a power window system. The switching device 100 has a case 1, and components such as a circuit board and switches which will be described later are accommodated inside the case 1. A concave 2 is formed on a part of an upper surface 1*e* of the case 1. Both ends of the concave 2 are opened and have slopes 3 inclined downward (FIG. 1 shows only one of the slopes 3). Projections 8 are formed integrally with the case 1 within the concave 2, and have a function of preventing entrance of water into the case 1. The details of the projections 8 will be described later. An operation knob 4 of a door lock switch is operated for locking the doors of the vehicle such that they cannot be opened, or for releasing the lock. An operation knob 5 of a window lock switch is operated for locking the windows of the vehicle such that they cannot be opened nor closed, or for releasing the lock. Two operation knobs 6 of window open/close switches are operated for opening and closing the windows of the vehicle. The operation knob 4 and the operation knobs 6 are seesaw-motion type knobs capable of swinging like a seesaw, and the operation knob 5 is a knob formed by a lock-type push button. Each of the operation knobs 6 has an operation section 6*a*, a cap section 6*b* formed integrally with the operation section 6*a*, and holes 6*c* formed on the side walls of the cap section 6*b*. While one hole 6*c* on each operation knob 6 is shown in FIG. 1, the same hole as the hole 6*c* is actually formed on the side wall opposite to the side wall where the hole 6*c* is provided.

Figure 2:
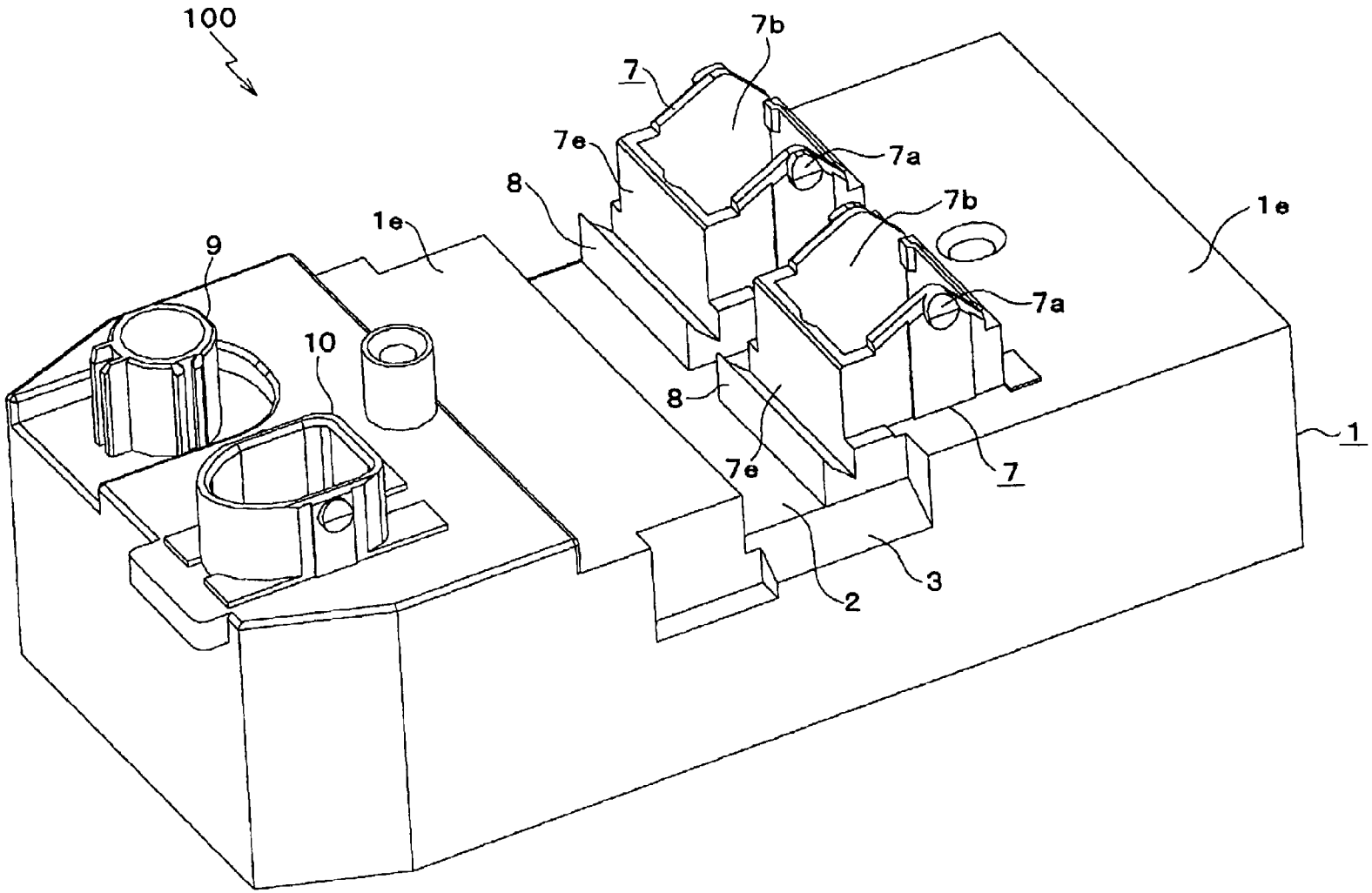
FIG. 2 illustrates an external appearance of the switching device from which operation knobs are removed.

FIG. 2 illustrates an external appearance of the switching device 100 in FIG. 1 from which the operation knobs 4, 5 and 6 are removed. Cylinders 7 are provided on the upper surface 1*e* of the case 1. Shafts 7*a* are formed integrally with the outer walls of each cylinder 7. The cylinders 7 are open to above, forming upper openings 7*b*. The shape of the horizontal cross section of the cylinders 7 is substantially rectangular in this embodiment, but the horizontal cross section of the cylinders 7 may have circular or other shapes. The projections 8 mentioned above are disposed in the vicinity of the respective cylinders 7. The projections 8 have approximately the same width as that of side walls 7*e* of the cylinders 7, and extend in a direction substantially parallel to the upper surface 1*e* of the case 1. The operation knob 5 shown in FIG. 1 is attached to a cylinder 9. The operation knob 4 shown in FIG. 1 is attached to a cylinder 10. In FIG. 2, the cap sections 6*b* of the operation knobs 6 shown in FIG. 1 are attached to the cylinders 7 from above to cover the upper openings 7*b* of the cylinders 7, and the holes 6*c* of the operation knobs 6 are brought into engagement with the shafts 7*a* of the cylinders 7. By this engagement, the operation knobs 6 are supported by the cylinders 7 such that the operation knobs 6 can swing around the shafts 7*a*.

Figure 3:
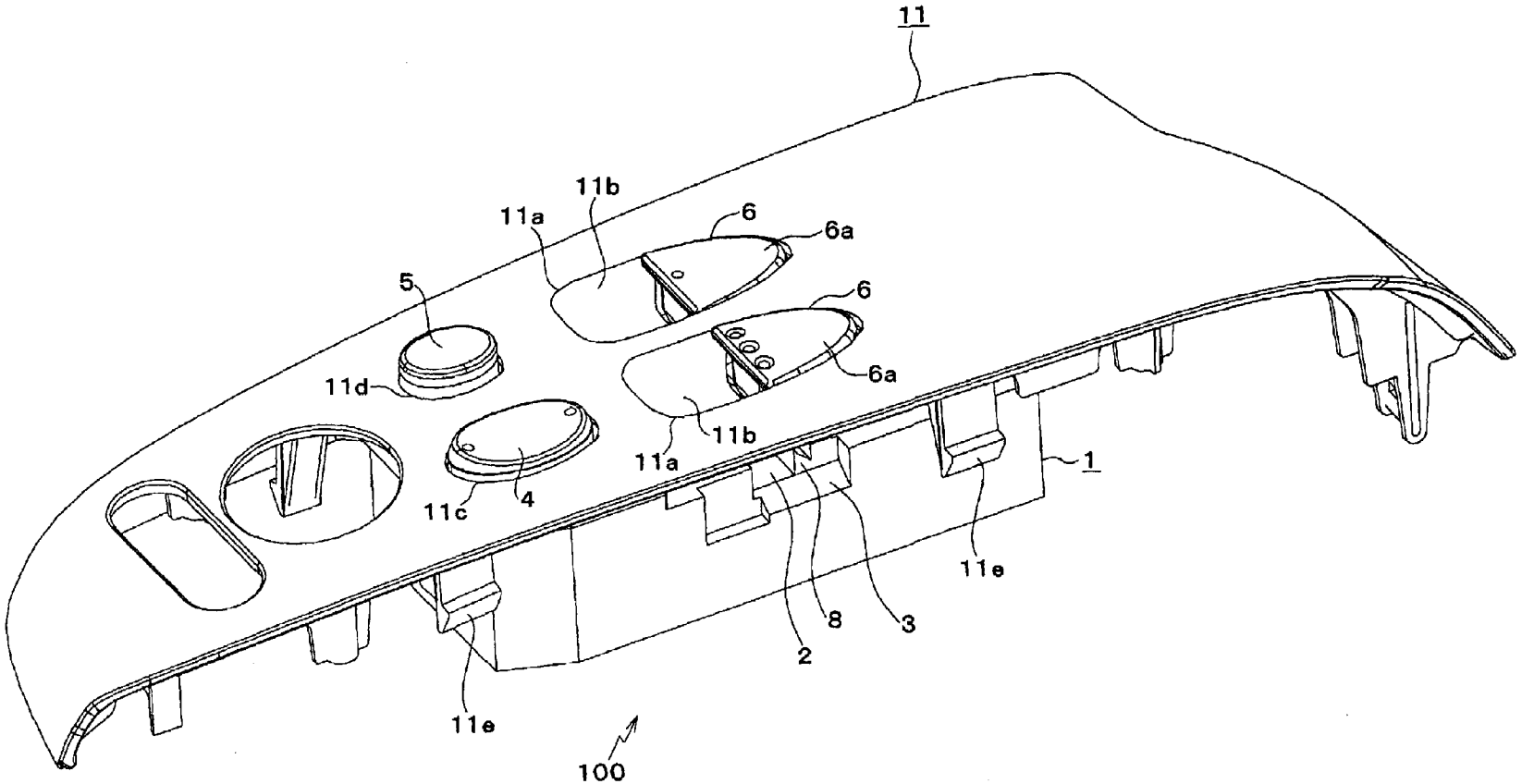
FIG. 3 illustrates an external appearance of the switching device to which a cover is attached.

FIG. 3 illustrates an external appearance of the switching device 100 shown in FIG. 1 to which a cover 11 is attached. The cover 11 covers the switching device 100 other than the portions corresponding to the operation knobs 4 through 6 when the switching device 100 is fitted to an arm rest (not shown) equipped on the door of the driver's seat of the vehicle. Two openings 11*a* through which the finger is inserted for operating the operation sections 6*a* of the operation knobs 6 are formed on the cover 11. The operation sections 6*a* are thus exposed through the respective openings 11*a*. An opening 11*c* through which the operation knob 4 is exposed and an opening 11*d* through which the operation knob 5 is exposed are also formed. Since the operation knobs 4 and 5 can be operated only by pushing those from above, the opening areas of the openings 1*c* and 11*d* are small. However, since the operation knobs 6 are lowered or raised with the finger put on the operation sections 6*a*, the opening areas of the openings 1*a* are large. Hook pieces 11*e* are equipped to attach the cover 11 to the arm rest.

Figure 4:
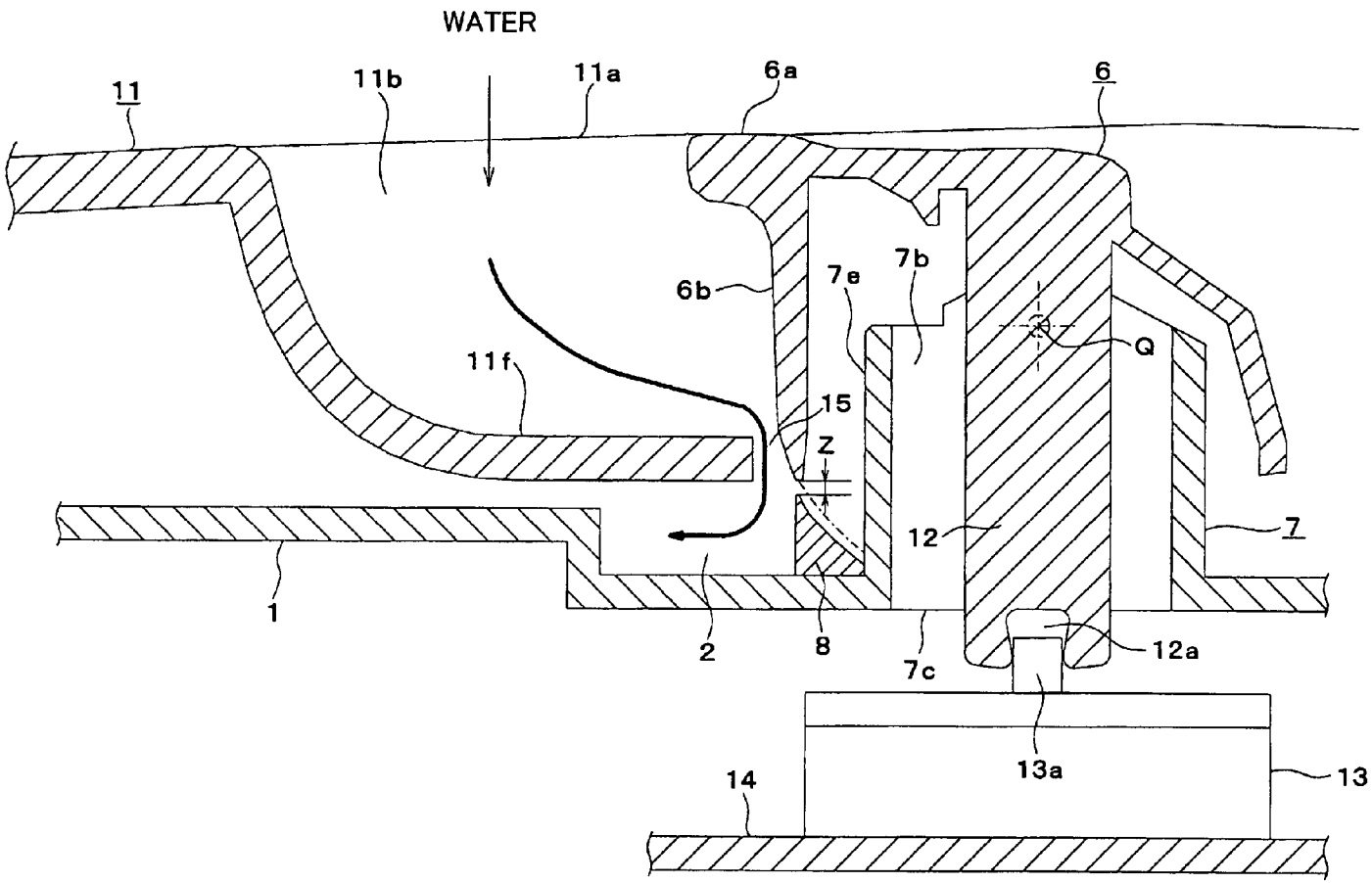
FIG. 4 is a cross-sectional view showing a main part of the switching device to which the cover is attached.
Figure 12:
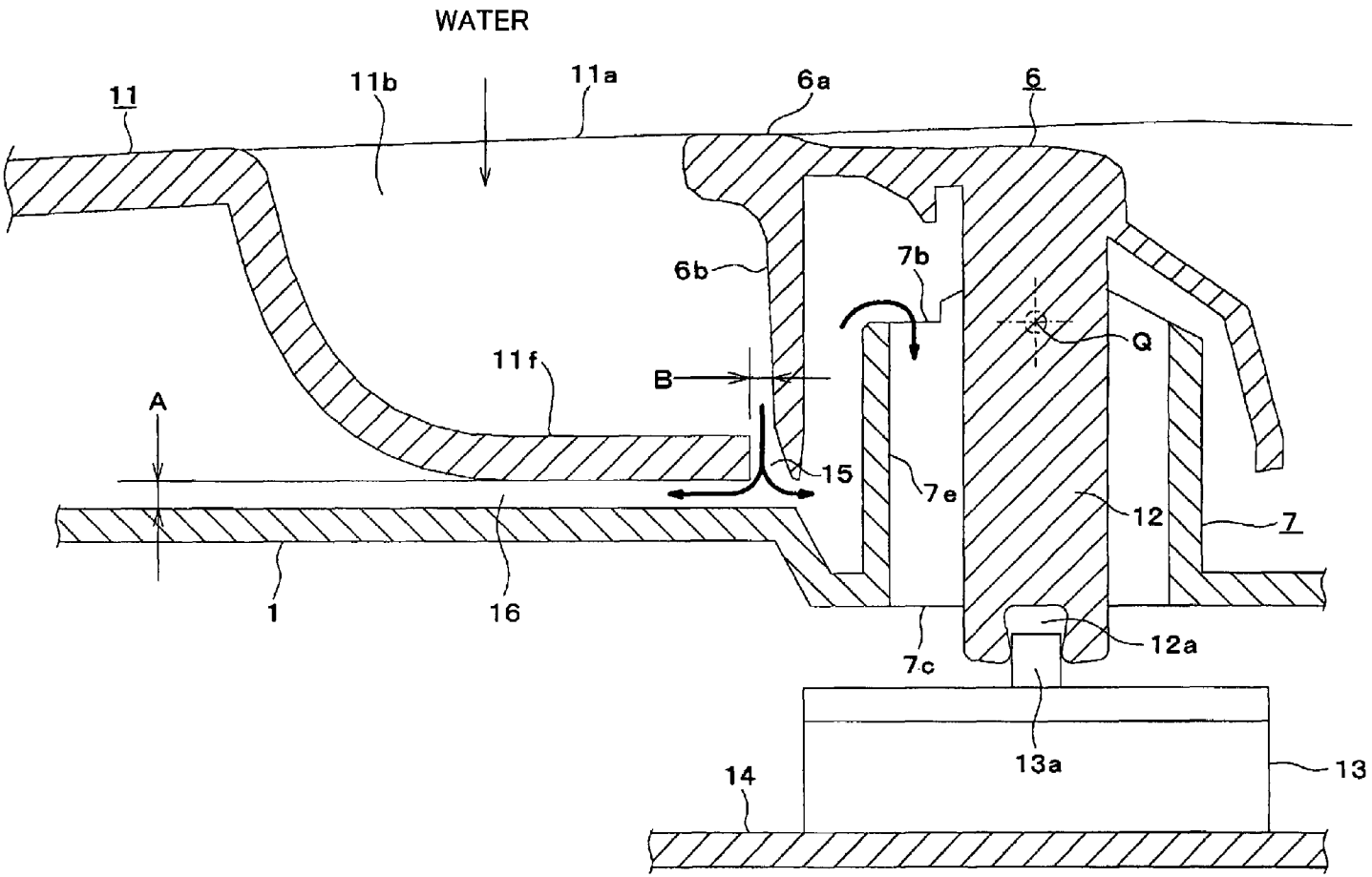
FIG. 12 (Prior Art)
FIG. 12 is a cross-sectional view showing a main part of the switching device shown in FIG. 11 to which a cover is attached.

FIG. 4 is a cross-sectional view of a main part of the switching device 100 to which the cover 11 is attached. As apparent from the figure, the cylinder 7 is a hollow cylinder which opens to above and below to communicate with the inside of the case 1. A circuit board 14 is provided within the case 1, and a switch 13 is packaged on the circuit board 14. The switch 13 is a switch for opening and closing a window, and is formed by a known slide switch. The switch 13 has an actuator 13*a*. An operation bar 12 connected to the operation knob 6 extends through a lower opening 7*c* of the cylinder 7 toward the inside of the case 1. A concave 12*a* is formed at the lower end of the operation bar 12. By engagement between the concave 12*a* and the actuator 13*a* of the switch 13, the motion of the operation knob 6 is transmitted through the operation bar 12 to the switch 13, and contacts equipped inside the switch 13 are switched between on and off in accordance with the operating position of the operation knob 6. A point Q is the rotation center of the operation knob 6, and corresponds to the position of the shaft 7*a* shown in FIG. 1. This structure is the same as that of the switching device 100 shown in FIG. 12.

Figure 5:
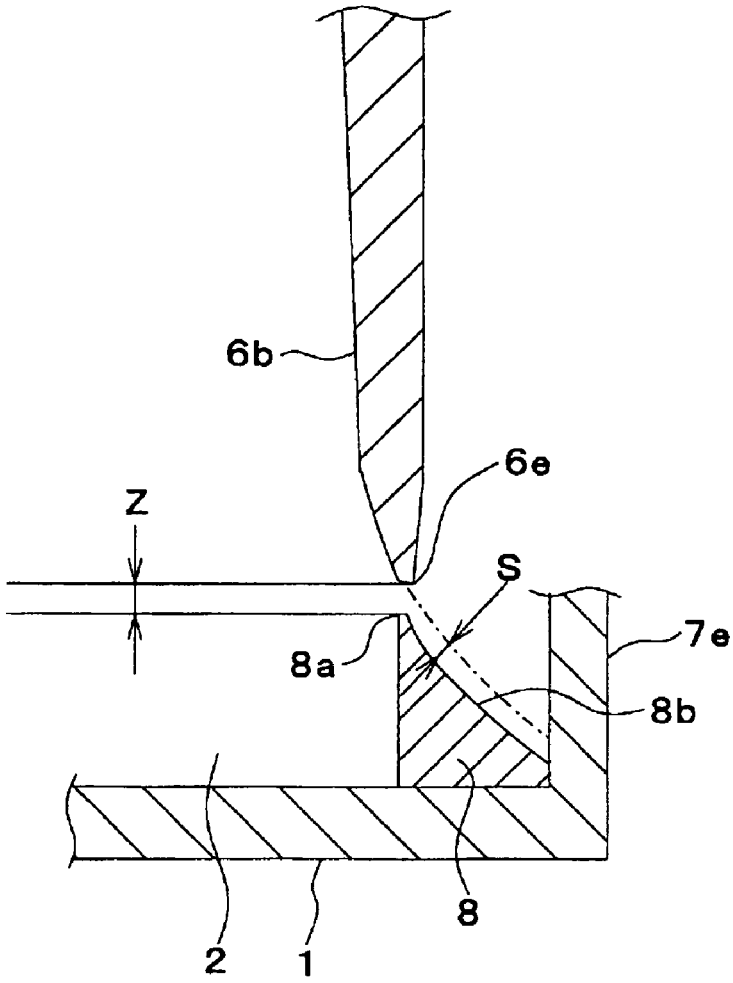
FIG. 5 is an enlarged cross-sectional view showing the main part of the switching device shown in FIG. 4.

FIG. 4 shows a condition where the operation knob 6 is not shifted, that is, the operation knob 6 is at the neutral position. In this condition, the lower end 6*e* of the cap section 6*b* of the operation knob 6 (hereinafter abbreviated as "knob lower end") and the upper end 8*a* of the projection 8 (hereinafter abbreviated as "projection upper end") are opposed to each other with a small clearance Z interposed therebetween, as also illustrated in FIG. 5. The length of the clearance Z is approximately 0.5 mm, for example. When the operation knob 6 is shifted to open or close the window, the knob lower end 6*e* moves away from the projection upper end 8*a*. As apparent from FIG. 4, the projection 8 is disposed outside a clearance formed between the cap section 6*b* of the operation knob 6 and the side wall 7*e* of the cylinder 7. Thus, interference between the cap section 6*b* and the projection 8 caused when the operation knob 6 swings is prevented.

The clearance between the knob lower end 6*e* and the projection upper end 8*a* increases as the knob lower end 6*e* shifts to the right from the projection upper end 8*a*. In this condition, water easily enters through the clearance. On the other hand, when the knob lower end 6*e* is shifted to the left from the projection upper end 8*a*, the projection 8 obstructs the swinging motion of the operation knob 6 in the counterclockwise direction. It is therefore preferable to dispose the knob lower end 6*e* and the projection upper end 8*a* opposed to each other by setting the horizontal distance between the knob lower end 6*e* and the projection upper end 8*a* at zero or by locating the knob lower end 6*e* at a position slightly to the right from the projection upper end 8*a*.

Figure 6:
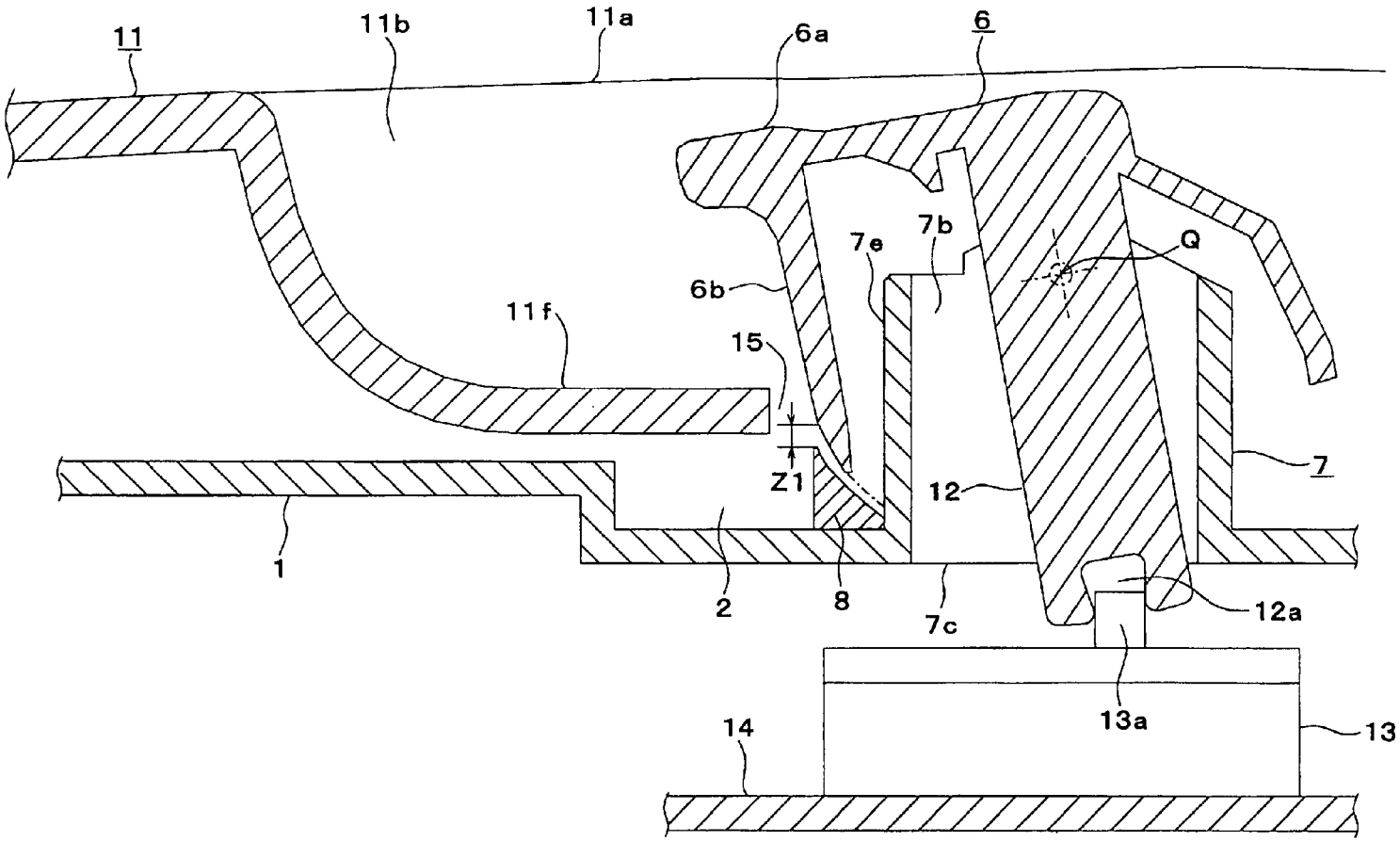
FIG. 6 is a cross-sectional view showing a main part of the switching device in a condition where the operation knob is shifted.
Figure 7:
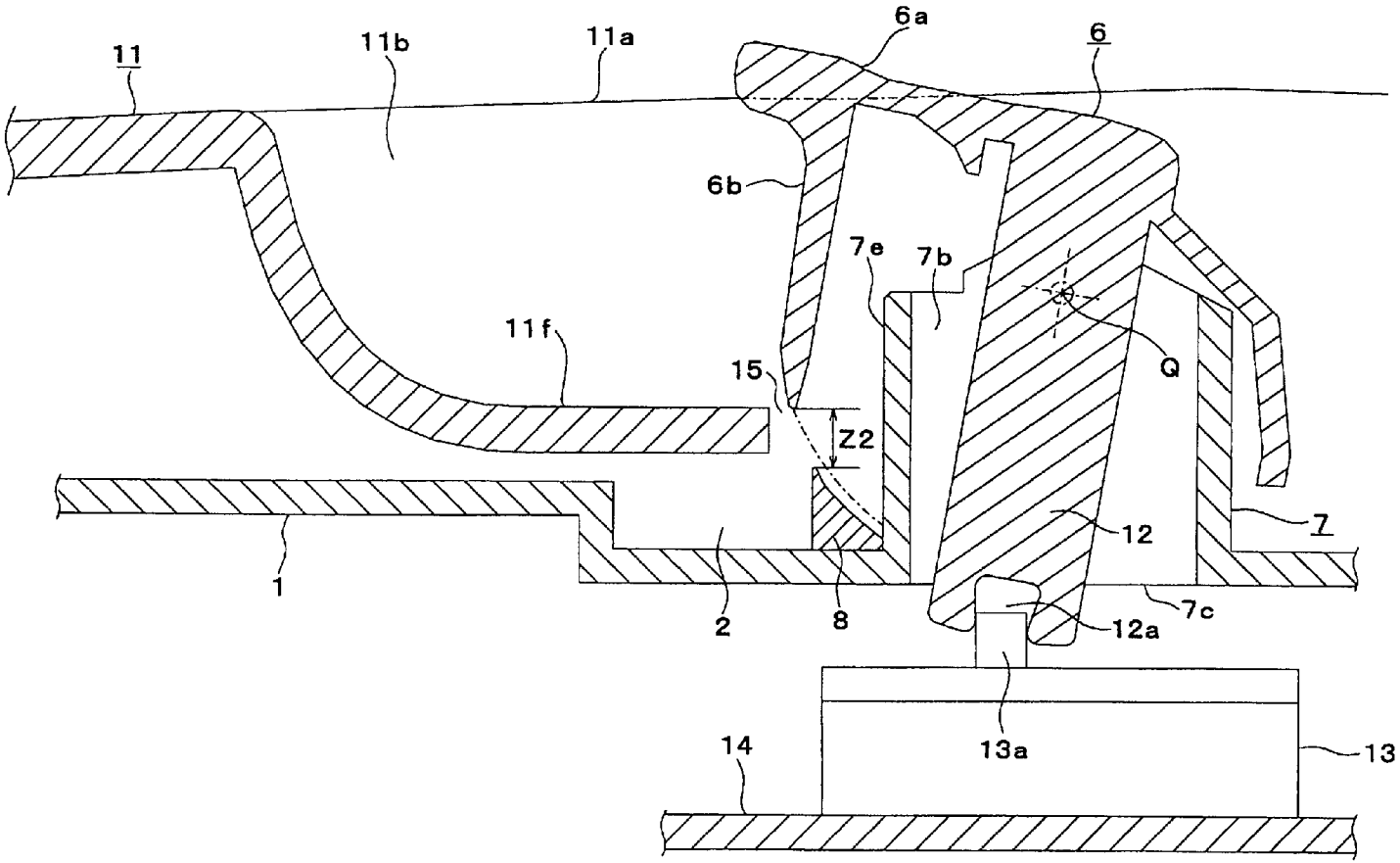
FIG. 7 is a cross-sectional view showing a main part of the switching device in a condition where the operation knob is shifted.

The clearance between the operation knob 6 and the projection 8 becomes the minimum, i.e., the small clearance Z mentioned above, when the operation knob 6 is located at the neutral position shown in FIG. 4. When the operation knob 6 swings anticlockwise from the neutral position, a clearance Z1 between the operation knob 6 and the projection 8 becomes larger than the clearance Z as shown in FIG. 6. When the operation knob 6 swings clockwise from the neutral position, a clearance Z2 between the operation knob 6 and the projection 8 also becomes larger than the clearance Z as shown in FIG. 7.

As illustrated in FIG. 5, the projection 8 has a tapered surface 8*b* which is inclined diagonally downward from the upper end 8*a*. The tapered surface 8*b* comes opposed to the cap section 6*b* of the operation knob 6 when the operation knob 6 swings anticlockwise (i.e., in the direction where the knob lower end 6*e* approaches the side wall 7*e* of the cylinder 7). The tapered surface 8*b* has a substantially circular-arc-shaped tapered surface which corresponds to a track defined by the knob lower end 6*e* when the operation knob 6 swings around the Q point (FIG. 4), that is, a track of a circle having a center of the Q point (shown by an alternate long and short dash line). A distance S between the track formed by the knob lower end 6*e* and the tapered surface 8*b* is set at approximately 0.5 mm which is equal to the clearance Z.

By providing the projection 8 having the structure explained above, entrance of water from below the operation knob 6 into the case 1 can be prevented. More specifically, water entering into the concave 11*b* of the cover 11 flows out of the concave 11*b* through a clearance 15 between a bottom wall 11*f* of the concave 11*b* and the cap section 6*b* of the operation knob 6, and most of the water is then blocked by the projection 8 and flows into the concave 2 as shown by a bold arrow in FIG. 4. Since the concave 2 is open at the both ends as illustrated in FIG. 1, the water coming to the concave 2 is discharged from the both sides of the concave 2 to the outside. Since the slopes 3 inclined downward are provided at the open ends of the concave 2, the water within the concave 2 can be smoothly discharged along the slopes 3. When a large amount of water flows into the concave 11*b*, the water enters through the small clearance Z between the operation knob 6 and the projection 8 by water pressure. However, since the amount of water entering therethrough is extremely smaller than that amount in the structure not including the projection 8, the level of water staying in the space between the cap section 6*b* of the operation knob 6 and the side wall 7*e* of the cylinder 7 does not exceed the height of the side wall 7*e*. Accordingly, entrance of water from the upper opening 7*b* through the lower opening 7*c* of the cylinder 7 into the case 1 can be prevented.

The clearance between the operation knob 6 and the projection 8 becomes the minimum equivalent to the small clearance Z when the operation knob 6 is not shifted. Thus, entrance of water into the case 1 can be effectively prevented in the normal condition where the operation knob 6 is not operated. Moreover, the tapered surface 8*b* of the projection 8 opposed to the operation knob 6 when the operation knob 6 is shifted is provided in this embodiment. Thus, entrance of water into the case 1 can be effectively prevented not only when the operation knob 6 is not shifted but also when the operation knob 6 is shifted by decreasing the opposing distance between the operation knob 6 and the tapered surface 8*b* to such an extent that the motion of the operation knob 6 is not obstructed. Furthermore, since the tapered surface 8*b* has the substantially circular-arc shape corresponding to the track defined by the knob lower end 6*e*, the distance between the operation knob 6 and the projection 8 when the operation knob 6 is shifted can be decreased. Accordingly, the waterproofing effect can be enhanced.

Figure 8:
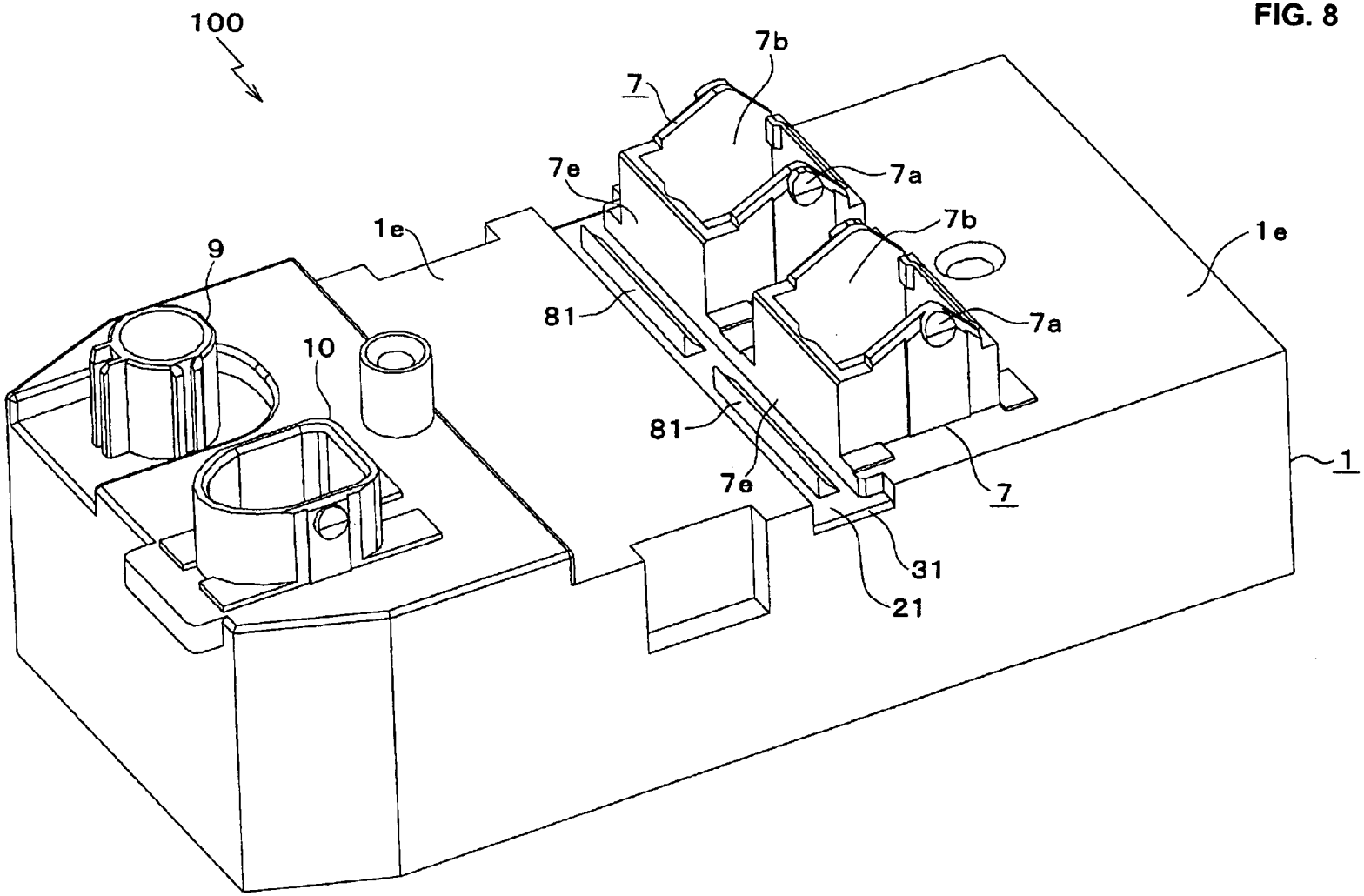
FIG. 8 illustrates an external appearance of a switching device in another embodiment according to the invention.
Figure 9:
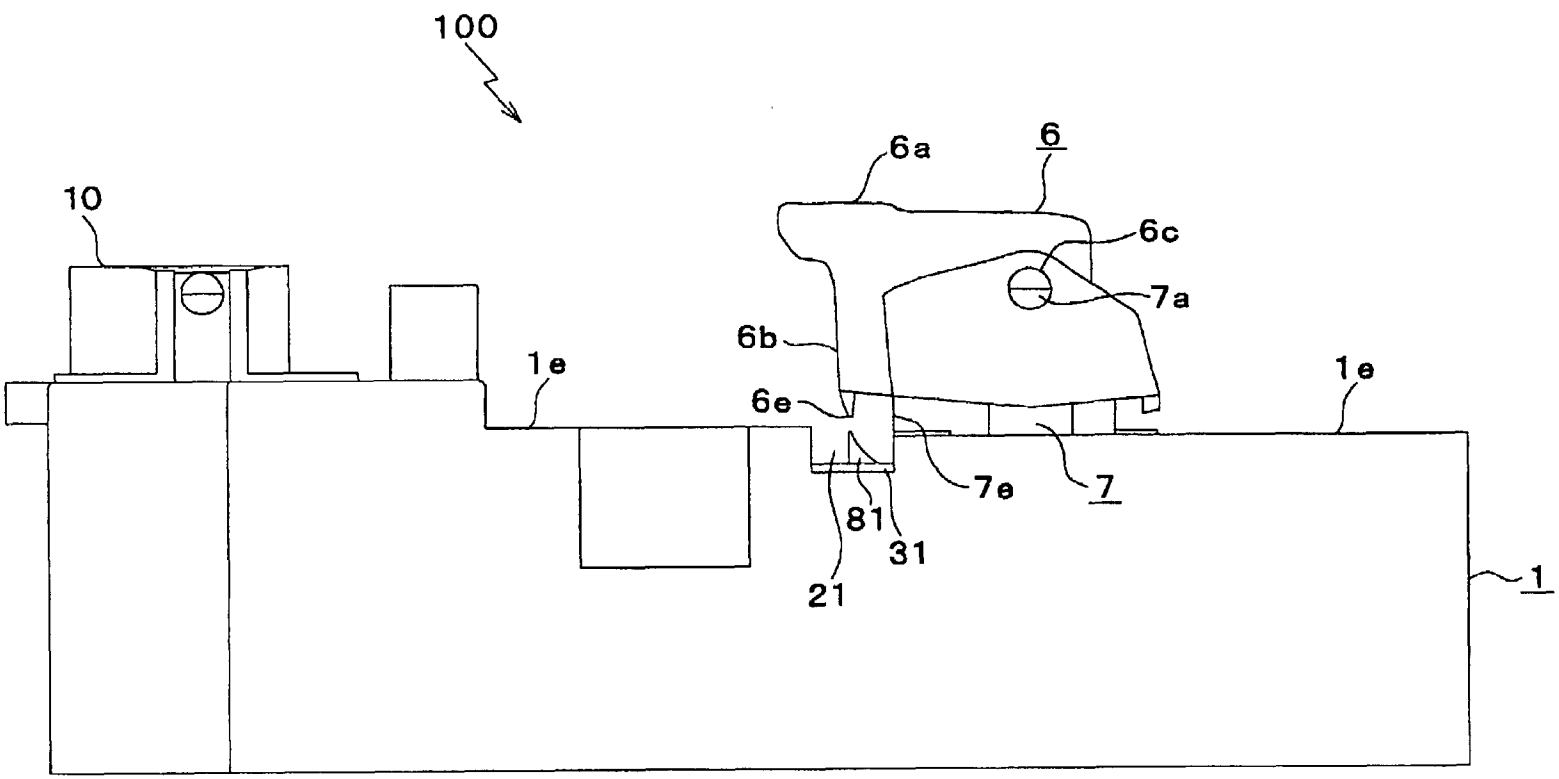
FIG. 9 is a side view of the switching device in the embodiment shown in FIG. 8.

FIGS. 8 and 9 illustrate an example of the switching device 100 in another embodiment according to the invention. FIG. 8 shows an external appearance of the switching device 100 from which the operation knobs 6 are removed. FIG. 9 is a side view showing the switching device 100 to which the operation knobs 6 are attached. In the respective figures, similar reference numerals are given to similar components shown in FIGS. 1 through 7. A concave 21 is formed on the case 1. Slopes 31 are formed at both open ends of the concave 2 (one of the slopes 31 is shown in FIGS. 8 and 9). Projections 81 are formed integrally with the case 1 within the concave 21.

While the projections 8 are disposed along one side of the concave 2 (on the cylinder 7 side) in FIG. 2, the projections 81 are positioned in the middle of the concave 21 in FIG. 8. The shape of the projections 81 is the same as that of the projections 8. The depth of the concave 21 is smaller than that of the concave 2 shown in FIG. 2. The area of the slopes 31 is smaller than that of the slopes 3 shown in FIG. 2. Similarly to the above embodiment, entrance of water into the case 1 can be prevented by the projections 81 in this embodiment.

Figure 10A:
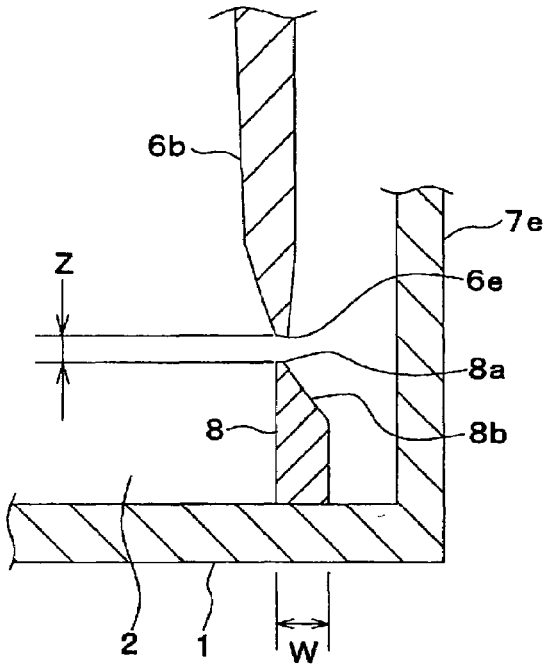
FIGS. 10A and 10B are enlarged cross-sectional views of main parts of switching devices in still other embodiments according to the invention.
Figure 10B:
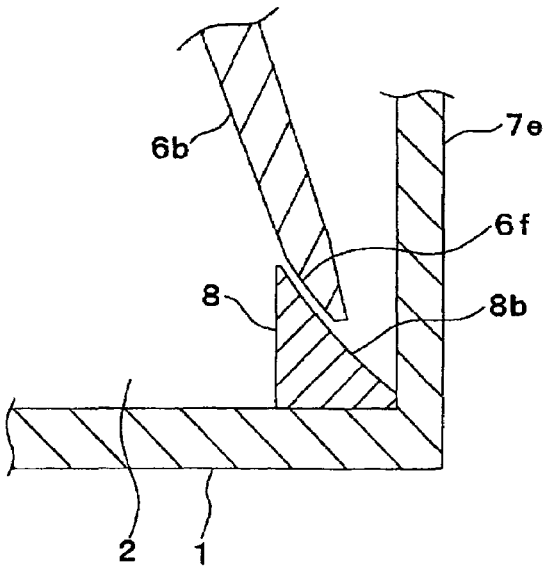
Figure 11:
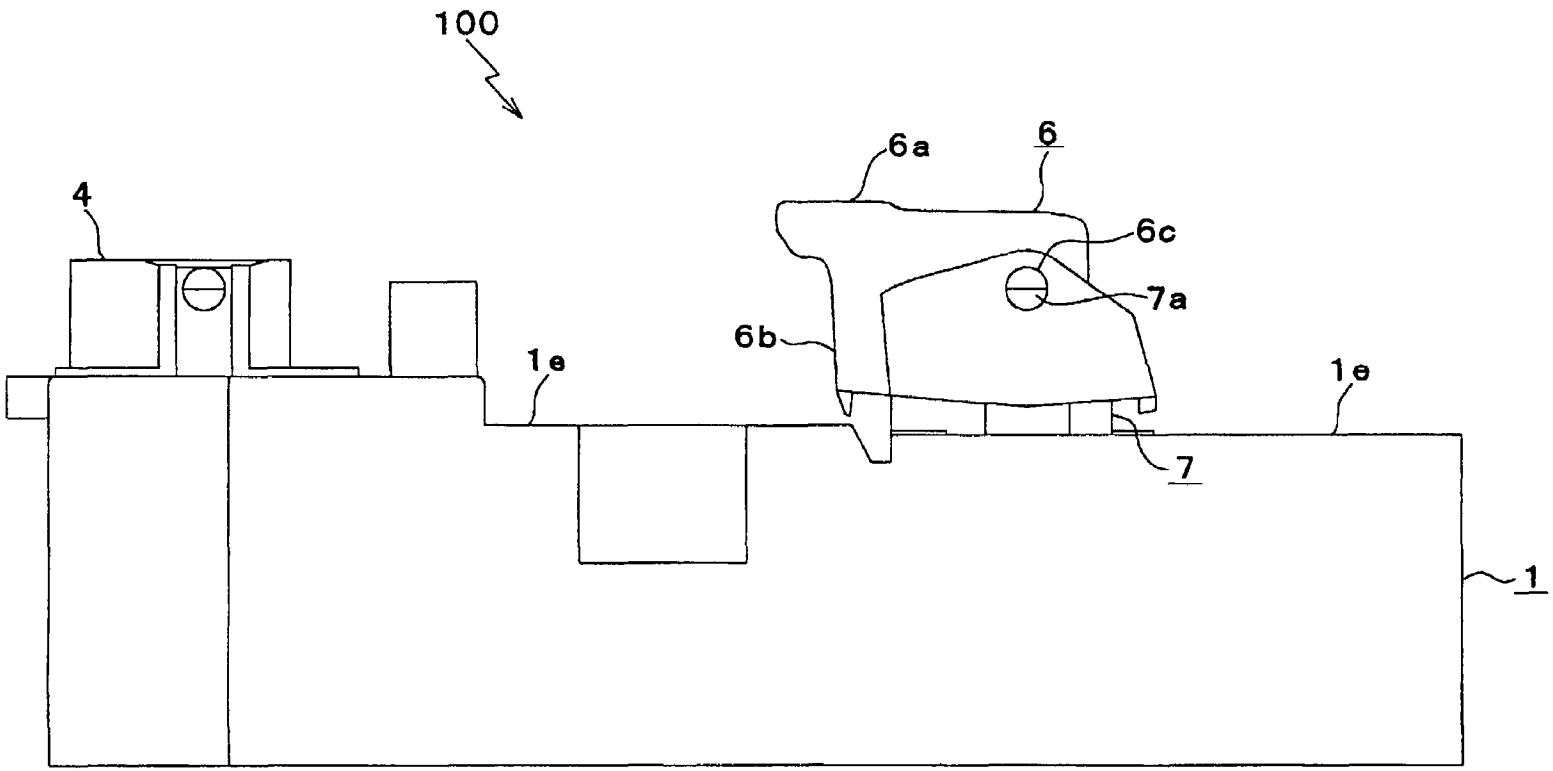
FIG. 11 (Prior Art)
FIG. 11 is a side view schematically showing a structure of a conventional switching device.

FIGS. 10A and 10B are enlarged cross-sectional views showing a main part of the switching device 100 in still other embodiments according to the invention. FIG. 10A shows an example in which the width W of the projection 8 in the horizontal direction is smaller than that width in the structure shown in FIG. 5. This figure shows a condition where the operation knob 6 is not shifted but is located at the neutral position. If waterproofing is required only when the operation knob 6 is at the neutral position, the projection 8 having such a small width as in this example is sufficient. FIG. 10B shows an example in which a tapered surface 6*f* is formed on the cap section 6*b* of the operation knob 6 at the position opposed to the tapered surface 8*b* of the projection 8. The tapered surface 6*f* has a substantially circular-arc shape similar to the substantially circular-arc shape of the tapered surface 8*b*. This figure shows a condition where the operation knob 6 is shifted. In this condition, the clearance between the tapered surfaces 6*f* and 8*b* is kept constant in the range that those tapered surfaces are opposed to each other, and is decreased to the minimum to such an extent that the swinging motion of the operation knob 6 is not obstructed. As a result, the waterproofing effect can be further enhanced.

As apparent from the above embodiments, when spilt beverage or the like flows through the openings 11*a* into the concaves 11*b* of the cover 11, the water approaching the inside of the cylinders 7 is blocked by the projections 8 or 81. Even when an extremely small amount of water enters through the small clearances Z, the water is prevented from entering from below the operation knobs 6 through the upper openings 7*b* of the cylinders 7 into the case 1 since the amount of water is small. Accordingly, the switching device 100 can be effectively waterproofed.

In the respective embodiments described herein, the invention is applied to the switching device used in the power window system. However, the invention is also applicable to switching devices used in door open/close systems or other devices. Furthermore, the invention is applicable to switching devices used for purposes other than vehicle equipment.

What is claimed is:

1. A switching device, comprising:

a switch;

a case within which the switch is accommodated;

a hollow cylinder which is provided on an upper surface of the case and open to above and below to communicate with the inside of the case;

an operation knob provided to cover an upper opening of the cylinder such that the operation knob can swing; and an operation bar which extends through a lower opening of the cylinder into the case to transmit the motion of the operation knob to the switch, wherein:

a projection for preventing water from entering through a space between the operation knob and the cylinder into the case is provided on the upper surface of the case in a vicinity of the cylinder; and a lower end of the operation knob is opposed to an upper end of the projection with a small clearance interposed therebetween when the operation knob is not shifted, and the lower end of the operation knob moves away from the upper end of the projection when the operation knob is shifted.

2. A switching device according to claim 1, wherein the space between the operation knob and the projection becomes the minimum equal to the small clearance when the operation knob is not shifted.

3. A switching device according to claim 2, wherein the projection has a tapered surface which comes opposed to the operation knob when the operation knob is shifted.

4. A switching device according to claim 3, wherein the tapered surface has a substantially circular-arc shape corresponding to a track defined by the lower end of the operation knob when the operation knob swings.

5. A switching device according to claim 1, wherein the projection has a tapered surface which comes opposed to the operation knob when the operation knob is shifted.

6. A switching device according to claim 5, wherein the tapered surface has a substantially circular-arc shape corresponding to a track defined by the lower end of the operation knob when the operation knob swings.

* * * * *